US011293142B2

(12) United States Patent
Giuste et al.

(10) Patent No.: US 11,293,142 B2
(45) Date of Patent: Apr. 5, 2022

(54) SMOOTH AND LOW DENSITY PAPERBOARD STRUCTURES AND METHODS FOR MANUFACTURING THE SAME

(71) Applicant: WestRock MWV, LLC, Atlanta, GA (US)

(72) Inventors: Sergio A. Giuste, Midlothian, VA (US); Steven Parker, Raleigh, NC (US); Terrell J. Green, Raleigh, NC (US)

(73) Assignee: WESTROCK MWV, LLC, Atlanta, GA (US)

( * ) Notice: Subject to any disclaimer, the term of this patent is extended or adjusted under 35 U.S.C. 154(b) by 0 days.

(21) Appl. No.: 16/869,156

(22) Filed: May 7, 2020

(65) Prior Publication Data

US 2020/0354894 A1 Nov. 12, 2020

Related U.S. Application Data

(60) Provisional application No. 62/846,278, filed on May 10, 2019.

(51) Int. Cl.

| | |
|---|---|
| ***D21H 19/58*** | (2006.01) |
| ***D21G 1/02*** | (2006.01) |
| ***D21H 19/38*** | (2006.01) |
| ***D21H 19/40*** | (2006.01) |
| ***D21H 19/54*** | (2006.01) |
| ***D21H 19/82*** | (2006.01) |
| ***D21H 23/30*** | (2006.01) |

(52) U.S. Cl.

CPC ..... *D21H 19/58* (2013.01); *D21G 1/0246* (2013.01); *D21G 1/0253* (2013.01); *D21H 19/385* (2013.01); *D21H 19/40* (2013.01); *D21H 19/54* (2013.01); *D21H 19/822* (2013.01); *D21H 23/30* (2013.01)

(58) Field of Classification Search

USPC ..... 162/136

See application file for complete search history.

(56) References Cited

U.S. PATENT DOCUMENTS

| | | | |
|---|---|---|---|
| 4,749,445 | A | 6/1988 | Vreeland |
| 4,823,688 | A | 4/1989 | Wedel et al. |
| 4,888,983 | A | 12/1989 | Dunfield et al. |
| 5,245,920 | A | 9/1993 | Hess |
| 5,298,335 | A | 3/1994 | Reed et al. |
| 5,320,672 | A | 6/1994 | Whalen-Shaw |
| 5,378,497 | A | 1/1995 | Johnson et al. |
| 5,631,080 | A | 5/1997 | Fugitt |
| 5,690,527 | A | 11/1997 | Rutledge et al. |
| 6,200,424 | B1 | 3/2001 | Saari et al. |
| 6,274,001 | B1 | 8/2001 | Mohan |
| 6,582,553 | B2 | 6/2003 | Jewell et al. |
| 6,698,342 | B1 | 3/2004 | Heikkinen et al. |
| 6,777,075 | B2 | 8/2004 | Concannon et al. |
| 6,802,938 | B2 | 10/2004 | Mohan et al. |
| 6,866,906 | B2 | 3/2005 | Williams et al. |
| 7,208,039 | B2 | 4/2007 | Jones et al. |
| 7,306,668 | B2 | 12/2007 | Pring et al. |
| 7,425,246 | B2 | 9/2008 | Urscheler |
| 7,504,002 | B2 | 3/2009 | Brelsford et al. |
| 7,749,583 | B2 | 7/2010 | Fugitt et al. |
| 8,142,887 | B2 | 3/2012 | Fugitt et al. |
| 9,567,709 | B2 | 2/2017 | Fugitt et al. |
| 2003/0085012 | A1 | 5/2003 | Jones et al. |
| 2004/0065423 | A1 | 4/2004 | Swerin et al. |
| 2004/0229063 | A1 | 11/2004 | Concannon et al. |
| 2005/0039872 | A1 | 2/2005 | Kimura et al. |
| 2006/0009566 | A1 | 1/2006 | Jones et al. |
| 2006/0124033 | A1 | 6/2006 | Pruett et al. |
| 2007/0169902 | A1 | 7/2007 | Brelsford et al. |
| 2008/0060774 | A1 | 3/2008 | Zuraw et al. |
| 2008/0311416 | A1 | 12/2008 | Kelly et al. |
| 2009/0236062 | A1* | 9/2009 | Fugitt ..... D21H 11/04 162/109 |

(Continued)

FOREIGN PATENT DOCUMENTS

| | | |
|---|---|---|
| EP | 0448332 | 9/1991 |
| EP | 1470289 | 8/2003 |
| JP | 01-118692 | 5/1989 |

(Continued)

OTHER PUBLICATIONS

Steffner et al., "Influence of the calendering conditions on the structure and the properties of woodfree paper—A comparison between soft nip calendering and hard nip calendering," *Nordic Pulp & Paper Research Journal*, vol. 13, No. 1 (2018).

(Continued)

*Primary Examiner* — Mark Halpern

(74) *Attorney, Agent, or Firm* — Neil G. Cohen

(57) ABSTRACT

A method for manufacturing a paperboard structure includes passing a paperboard substrate through a hot-hard calender to yield a calendered paperboard substrate, the hot-hard calender including a nip defined by a thermo-roller and a counter roller, wherein a contact surface of the thermo-roller is heated to an elevated temperature. The method then includes applying a basecoat to the calendered paperboard substrate to yield a basecoated paperboard substrate, the basecoat includes a basecoat binder and a basecoat pigment blend. The method further includes applying a topcoat to the basecoated paperboard substrate.

23 Claims, 7 Drawing Sheets

(56) References Cited

U.S. PATENT DOCUMENTS

2015/0136349 A1 5/2015 Pietikaimen et al.

FOREIGN PATENT DOCUMENTS

| | | |
|---|---|---|
| JP | 2009001953 | 1/2009 |
| JP | 2009013513 | 1/2009 |
| WO | WO 98/51860 | 11/1998 |
| WO | WO 01/14014 | 1/2001 |
| WO | WO 2006/033952 | 3/2006 |
| WO | WO 2009/091406 | 7/2009 |

OTHER PUBLICATIONS

Rättö, "Description and analysis of paper deformation in a calender nip—effects of high roll temperatures and thickness variations," *Nordic Pulp & Paper Research Journal*, vol. 17, No. 2 (2002).
Endres et al., "Influence of calendering conditions on paper surface characteristics : a comparison between hard-nip, soft-nip, and extended soft-nip calendering," *TAPPI Journal*, vol. 4, No. 9, pp. 9-14 (2005).

* cited by examiner

SMOOTH AND LOW DENSITY PAPERBOARD STRUCTURES AND METHODS FOR MANUFACTURING THE SAME

PRIORITY

This application claims priority from U.S. Ser. No. 62/846,278 filed on May 10, 2019. The entire contents of U.S. Ser. No. 62/846,278 are incorporated herein by reference.

FIELD

The present patent application relates to smooth, low-density paperboard and to methods for manufacturing the same.

BACKGROUND

Paperboard is used in various packaging applications. For example, aseptic liquid packing paperboard is used for packaging beverage cartons, boxes and the like. Therefore, customers often prefer paperboard having a generally smooth surface with few imperfections to facilitate the printing of high quality text and graphics, thereby increasing the visual appeal of products packaged in paperboard.

Conventionally, paperboard smoothness is achieved by a wet stack calendering process in which the paperboard is rewetted and passed through a calendering device having two or more hard rolls. The wet stack calendering process smooths the paperboard by compressing the fiber network (e.g., applies a nip load) to reduce the pits and crevices in the raw stock board. Therefore, smooth paperboard is typically more dense (e.g., less bulky) than less smooth paperboard.

Nonetheless, low density is a desirable quality in many paperboard applications. However, preparing a smooth paperboard using conventional processes generally requires substantially increasing paperboard density.

Accordingly, those skilled in the art continue with research and development efforts in the field of paperboard manufacturing.

SUMMARY

In one aspect, the disclosed method for manufacturing a paperboard structure includes passing a paperboard substrate through a hot-hard calender to yield a calendered paperboard substrate, the hot-hard calender including a nip defined by a thermo-roller and a counter roller, wherein a contact surface of the thermo-roller is heated to an elevated temperature. The disclosed method then includes applying a basecoat to the calendered paperboard substrate to yield a basecoated paperboard substrate, the basecoat includes a basecoat binder and a basecoat pigment blend. The disclosed method further includes applying a topcoat to the basecoated paperboard substrate. The paperboard structure has a basis weight, a caliper thickness and a Parker Print Surf smoothness, the Parker Print Surf smoothness being at most about 3 microns, the basis weight being at most $Y_2$ pounds per 3000 $ft^2$, wherein $Y_2$ is a function of the caliper thickness (X) in point (1 point=one thousandth of an inch) and is calculated as follows:

$$Y_2=3.71+13.14X-0.1602X^2.$$

In another aspect, the disclosed method for manufacturing a paperboard structure includes passing a paperboard substrate through a hot-hard calender to yield a calendered paperboard substrate, the hot-hard calender including a nip defined by a thermo-roller and a counter roller, wherein a contact surface of the thermo-roller is heated to an elevated temperature. The disclosed method then includes applying a basecoat to the calendered paperboard substrate to yield a basecoated paperboard substrate, the basecoat includes a basecoat binder and a basecoat pigment blend. The disclosed method further includes applying a topcoat to the basecoated paperboard substrate.

Other aspects of the disclosed method for manufacturing a paperboard structure, and the paperboard structures manufactured by such methods, will become apparent from the following detailed description, the accompanying drawings and the appended claims.

DETAILED DESCRIPTION

Figure 1:
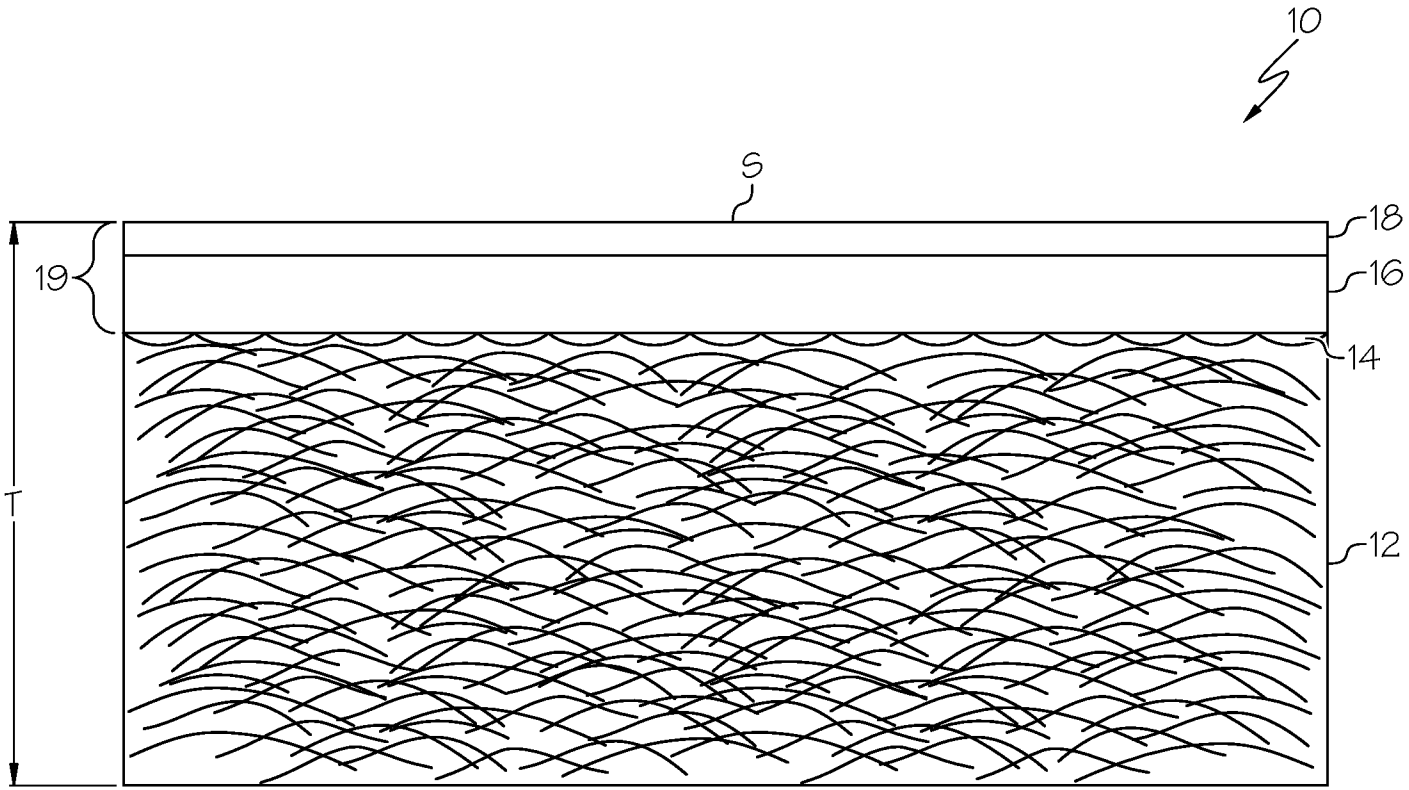
FIG. 1 is a cross-sectional view an example smooth, low density paperboard structure.

Referring to FIG. 1, an example paperboard structure 10 that may be manufactured using the method 20 disclosed herein is shown. The paperboard structure 10 may have a caliper thickness T and an upper surface S upon which text or graphics may be printed. The paperboard structure also includes a paperboard substrate 12 and a coating structure 19.

The paperboard substrate 12 may be any paperboard material that is capable of being coated, such as with the disclosed basecoat 14. The paperboard substrate 12 may be bleached, and may be a single-ply substrate or a multi-ply substrate. However, use of an unbleached paperboard substrate 12 is also contemplated. Those skilled in the art will appreciate that the paperboard substrate 12 will be thicker and more rigid than paper. Generally, a paperboard substrate 12 has an uncoated basis weight of about 85 pounds per 3000 $ft^2$ or more. In one or more examples, however, the paperboard substrate 12 may have an uncoated basis weight of about 100 pounds per 3000 $ft^2$ or more. One specific, non-limiting example of an appropriate paperboard substrate 12 is solid bleached sulfate (SBS). In one particular example, the paperboard substrate 12 may include a substantially chemically (rather than mechanically) treated fiber, such as an essentially 100 percent chemically treated fiber. Examples of appropriate chemically treated fiber substrates include solid bleached sulfate paperboard or solid unbleached sulfate paperboard.

Additional components, such as binders, fillers, pigments and the like, may be added to the paperboard substrate 12 without departing from the scope of the present disclosure. Furthermore, the paperboard substrate 12 may be substantially free of plastic pigments for increasing bulk, such as hollow plastic pigments or expandable microspheres, or other chemical bulking agents. Still furthermore, the paperboard substrate 12 may be substantially free of ground wood particles.

The coating structure 19 includes a basecoat 14, a topcoat 18 and may include any number of intermediate coating layers 16. The basecoat 14, topcoat 18, and optional intermediate coating layers 16 may improve the smoothness of the surface S of the paperboard structure 10 without substantially reducing the caliper thickness T of the paperboard structure 10. The basecoat 14 is applied first, directly to the paperboard substrate 12, and may be followed by various intermediate coating layers 16. The topcoat 18 is applied last to form the outermost layer (e.g., the basecoat is positioned between the topcoat and the paperboard substrate). Once applied, the coating structure may have a total coat weight equal to the combined weight of the individual layers (e.g., basecoat 14, topcoat 18 and intermediate coating layers 16). The total coat weight may be measured after the coating structure has been dried. In one example, the coating structure may have a total coat weight, on a dry basis, ranging from about 8 lbs/3000 $ft^2$ to about 18 lbs/3000 $ft^2$. In another example, the coating structure may have a total coat weight, on a dry basis, ranging from about 10 lbs/3000 $ft^2$ to about 18 lbs/3000 $ft^2$. In yet another example, the coating structure may have a total coat weight, on a dry basis, ranging from about 12 lbs/3000 $ft^2$ to about 16 lbs/3000 $ft^2$.

The basecoat 14 includes a basecoat binder, a basecoat pigment (or basecoat pigment blend) and, optionally, various other components. In one particular implementation, the basecoat pigment blend includes ground calcium carbonate and hyperplaty clay (e.g., clay having a relatively high aspect ratio or shape factor). For example, the basecoat pigment blend may consist essentially of ground calcium carbonate and hyperplaty clay. The terms "aspect ratio" and "shape factor" refer to the geometry of the individual clay particles, specifically to a comparison of a first dimension of a clay particle (e.g., the diameter or length of the clay particle) to a second dimension of the clay particle (e.g., the thickness or width of the clay particle). The terms "hyperplaty," "high aspect ratio" and "relatively high aspect ratio" refer to aspect ratios generally in excess of 40:1, such as 50:1 or more, particularly 70:1 or more, and preferably 90:1 or more.

In one example, the hyperplaty clay of the basecoat pigment blend may include a platy clay wherein, on average, the clay particles have an aspect ratio of about 40:1 or more. In another example, the hyperplaty clay of the basecoat pigment blend may include a platy clay wherein, on average, the clay particles have an aspect ratio of about 70:1 or more. In yet another example, the hyperplaty clay of the basecoat pigment blend may include a platy clay wherein, on average, the clay particles have an aspect ratio of about 90:1 or more. An example of such a clay is BARRISURF™, which is available from Imerys Pigments, Inc. of Roswell, Ga.

The ground calcium carbonate of the basecoat pigment blend may range from fine to coarse depending on the particle size of the ground calcium carbonate. Wherein about 95 percent of the ground calcium carbonate particles are less than about 2 microns in diameter, the ground calcium carbonate is generally considered to be "fine." Wherein about 60 percent of the ground calcium carbonate particles are less than about 2 microns in diameter, the ground calcium carbonate is generally considered to be "coarse." Further, ground calcium carbonate may also be "extra coarse" when about 35 percent of the ground calcium carbonate particles are less than about 2 microns in diameter.

In one example, the basecoat pigment blend may include ground calcium carbonate wherein about 60 percent of the calcium particles are less than about 2 microns in diameter. An example of such a ground calcium carbonate is HYDROCARB® 60 available from Omya AG of Oftringen, Germany. In another example, the basecoat pigment blend may include ground calcium carbonate wherein about 45 percent of the calcium particles are less than about 2 microns in diameter. In yet another example, the basecoat pigment blend may include ground calcium carbonate wherein about 35 percent of the calcium particles are less than about 2 microns in diameter.

The ratio of ground calcium carbonate to hyperplaty clay in the basecoat pigment blend may vary. In one example, the ground calcium carbonate may be at least about 10 percent by weight of the basecoat pigment blend and at most about 60 percent by weight of the basecoat pigment blend. In another example, the ground calcium carbonate may be at least about 40 percent by weight of the basecoat pigment blend and at most about 60 percent by weight of the basecoat pigment blend. In yet another example, the basecoat pigment blend includes about 50 percent by weight ground calcium carbonate and about 50 percent by weight hyperplaty clay.

The basecoat binder may be any suitable binder and may be selected based on a variety of manufacturing considerations. In one example, the basecoat binder may include latex. In another example, the basecoat binder may include styrene-acrylic latex. Examples of suitable basecoat binders include RHOPLEX P-308 available from the Dow Chemical Corporation of Midland, Mich. and RESYN 1103 available from Celanese International Corporation of Irving, Tex. Likewise, the various other basecoat components may vary as well depending on manufacturing considerations. In one or more examples, however, the various other basecoat components may include a dispersant. An example of such a dispersant is BERCHEM 4842 available from Bercen, Inc. of Denham Springs, La.

The topcoat 18 may be applied to the paperboard substrate 12 after a basecoat 14 has been applied. The topcoat 18 may be any appropriate topcoat and may include a topcoat binder, a topcoat pigment blend, and various other components. The topcoat pigment blend may include calcium carbonate and clay. In one example, calcium carbonate may be at least about 50 percent by weight of the topcoat pigment blend and at most about 70 percent by weight of the topcoat pigment blend. In another example, the topcoat pigment blend may include about 60 percent by weight calcium carbonate and about 40 percent by weight clay. The topcoat pigment blend may vary or be substantially similar to the basecoat pigment blend in terms of the coarseness of the calcium carbonate and the aspect ratio of the clay. In one example, the topcoat pigment blend may include fine ground calcium carbonate, such as HYDROCARB® 90 available from Omya AG of Oftringen, Germany. In another example, the topcoat pigment blend may include clay, such as Kaofine 90 available from Thiele Kaolin Company of Sandersville, Ga. In yet another example, the topcoat pigment blend may include fine ground calcium carbonate and clay.

The topcoat binder may be any suitable binder and may be selected based on a variety of manufacturing considerations. In one example, the basecoat binder may include latex. In another example, the basecoat binder may include styrene-acrylic latex. Examples of suitable basecoat binders include RHOPLEX P-308 available from the Dow Chemical Corporation of Midland, Mich. and RESYN 1103 available from Celanese International Corporation of Irving, Tex. The various other topcoat components may similarly include any suitable additive such as a dispersant, a lubricant and polyvinyl alcohol. An example of a suitable lubricant is NOPCOTE C-104 available from Geo Specialty Chemicals, Inc. of Lafayette, Ind. An example of a suitable polyvinyl alcohol is SEKISUI SELVOL 205 available from Sekisui Specialty Chemicals America of Dallas, Tex.

Figure 2:
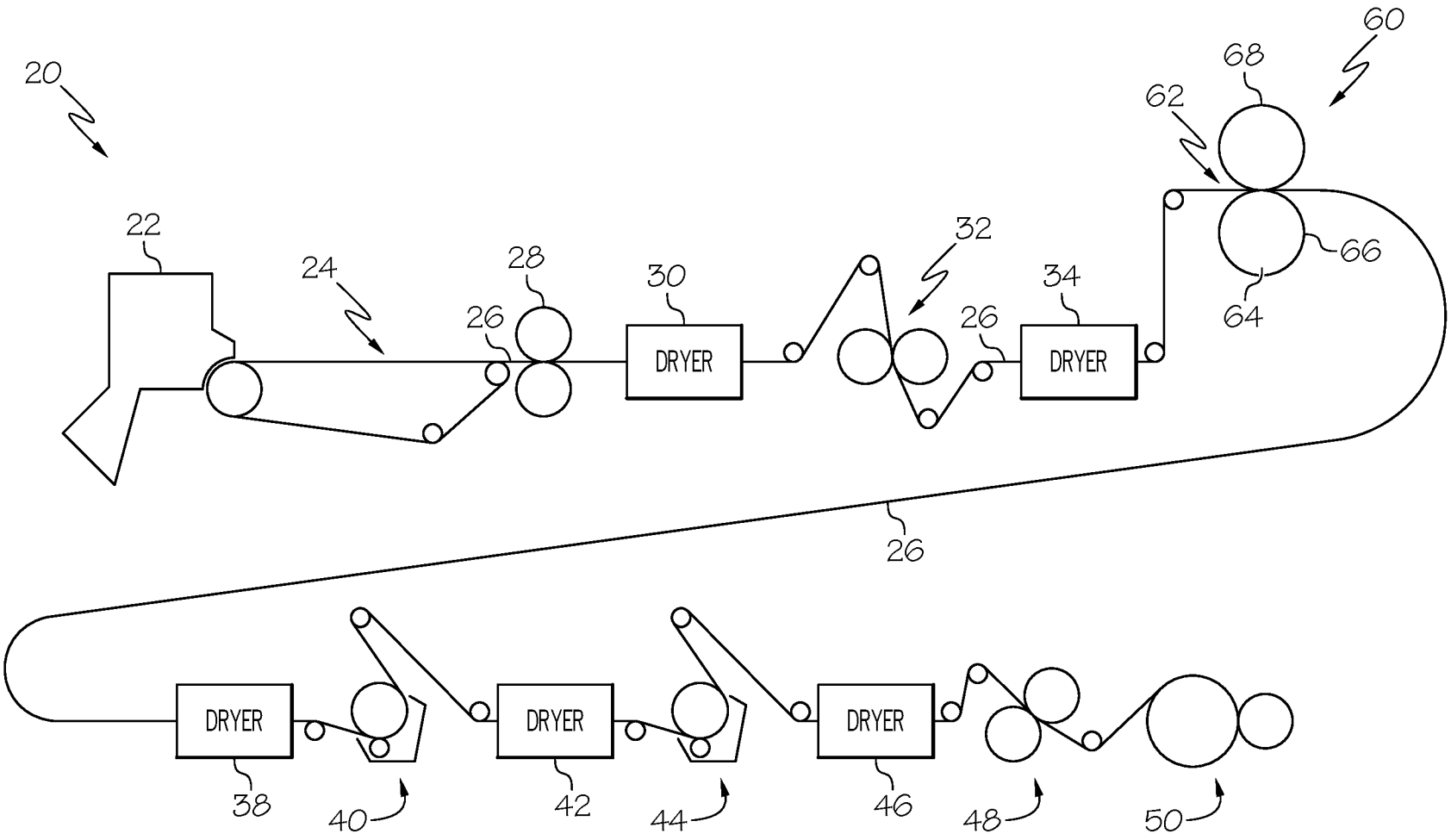
FIG. 2 is a schematic illustration of a first example of a method for manufacturing a smooth, low density paperboard structure.

Referring to FIG. 2, an example method 20 for manufacturing a paperboard structure 10 is illustrated. The method 20 may begin at the head box 22 which may discharge a fiber slurry onto a Fourdrinier 24 to form a paperboard substrate 26. The paperboard substrate 26 may pass through one or more wet presses 28 and, optionally through one or more dryers 30. A size press 32 may be used and may slightly reduce the caliper thickness of the paperboard substrate 26 and an optional dryer 34 may additionally dry the paperboard substrate 26.

Figure 3:
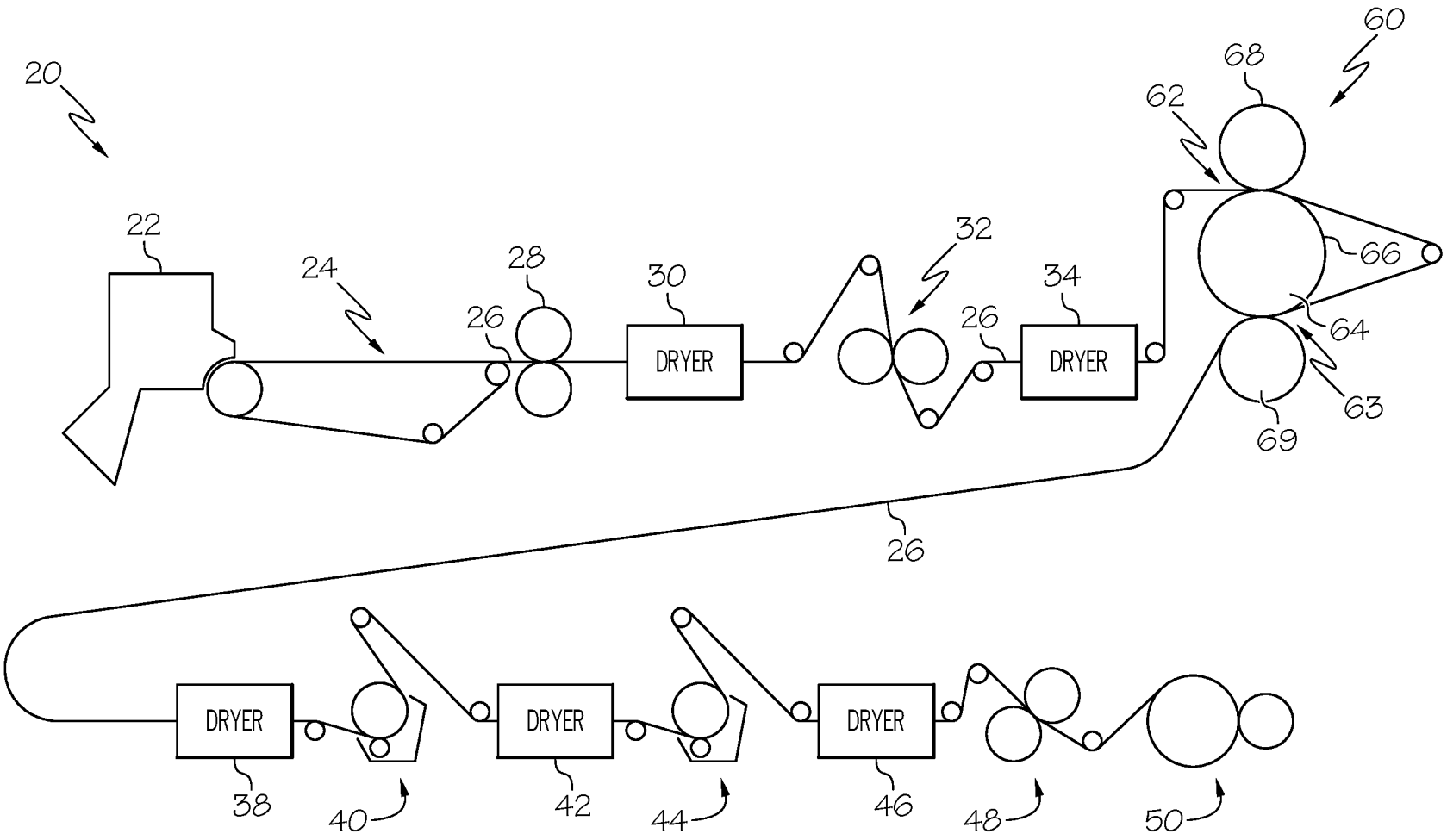
FIG. 3 is a schematic illustration of a second example of a method for manufacturing a smooth, low density paperboard structure.

The paperboard substrate 26 then passes through a hot-hard calender 60 to yield a calendered paperboard substrate. The hot-hard calender 60 includes a nip 62 wherein a nip load may be applied to the paperboard substrate 26. Further, the nip 62 is defined by a counter roller 68 and a thermo-roller 64. The counter roller 68 and/or the thermo-roller 64 may be made from a metallic material, such as steel or iron, or other suitably hard materials, such as a heat-resistant resin composite. The thermo-roller 64 includes at least one contact surface 66 (for contacting the paperboard substrate 26) that is heated to an elevated temperature. In another example, shown in FIG. 3, the hot-hard calender 60 may alternatively include a nip 62 and a second nip 63 wherein the nip 62 is defined by a thermo-roller 64 and a counter roller 68, and the second nip 63 is defined by same thermo-roller 64 and a second counter roller 69.

The nip load applied to the paperboard substrate 12 may vary. In an example, the nip load applied to the paperboard substrate 12 may range from about 20 pli (pounds per linear inch) to about 500 pli. In an example, the nip load applied to the paperboard substrate 12 may range from about 20 pli to about 350 pli. In an example, the nip load applied to the paperboard substrate 12 may range from about 20 pli to about 160 pli. In an example, the nip load applied to the paperboard substrate 12 may range from about 30 pli to about 140 pli.

While passing the paperboard substrate 12 through the hot-hard calender 60, the contact surface 66 of the thermo-roller 64 is heated to an elevated temperature so as to heat the paperboard substrate 12 as it is being calendered. In one example, the elevated temperature may be at least 250° F. In another example, the elevated temperature may be at least 300° F. In another example, the elevated temperature may be at least 400° F. In yet another example, the elevated temperature may be at least 500° F.

After being calendered, the paperboard substrate 12 may pass through another optional dryer 38 and to the first coater 40. The first coater 40 may be a blade coater or the like and may apply the basecoat 14 onto the paperboard substrate 12, thereby yielding a basecoated paperboard substrate. An optional dryer 42 may dry, at least partially, the basecoat 14 prior to application of another coat. A second coater 44 may then apply a topcoat 18 to the basecoated paperboard substrate, thereby yielding the paperboard structure. Another optional dryer 46 may finish the drying process before the paperboard substrate 26 proceeds to the optional gloss calender 48 and the paperboard substrate 26 is rolled onto a reel 50. Those skilled in the art will appreciate that additional coaters may utilized after the application of the basecoat 14 and before the application of the topcoat 18 without departing from the scope of the present disclosure. These additional coaters may apply, for example, intermediate coating layers 16.

At this point, those skilled in the art will appreciate that the basecoats 14, topcoats 18, intermediate coating layers 16 and associated application techniques disclosed above may substantially increase the smoothness of the resulting paperboard structure 10 while essentially maintain the caliper thickness of the paperboard substrate throughout the coating process, thereby yielding a smooth (e.g., a Parker Print Surf smoothness of 3 microns or less), low density paperboard structure 10.

EXAMPLES

Specific example of smooth, low density paperboard prepared in accordance with the present disclosure are presented below.

Example 1

An uncoated solid bleached sulfate (SBS) paperboard substrate having a basis weight of about 145 lbs/3000 $ft^2$ was prepared using a full-scale production process. Starch was applied to the surface of the SBS board during production.

The paperboard substrate was calendered by Valmet Technologies Oy of Järvenpää, Finland, using a hot-hard calender having a two roll (e.g., one nip) design. The hot-hard calender included one thermo-roller and one counter roller. The nip load was about 140 pli and the surface temperature of the thermo-roller was about 480° F.

A basecoat was prepared as a mixture of 50 parts high aspect ratio clay, 50 parts of extra coarse calcium carbonate, 17 parts of a Styrene-Acrylic Binder, 4 parts of a surfactant stabilized polyvinyl acetate, and minor amounts of dispersant.

A topcoat was also prepared as a mixture of 60 parts of fine carbonate, 40 parts of fine clay, 9 parts of Styrene-Acrylic Binder, 3 parts of a surfactant stabilized polyvinyl acetate, less than 2% of Polyvinyl Alcohol, and minor amounts of dispersant and lubricant.

The calendered paperboard substrate was then coated on one side (C1S) with the basecoat and then the topcoat. The total quantity of applied coating (basecoat and topcoat) was about 14 lbs/3000 $ft^2$.

The coated paperboard structure was then final calendered using a gloss-type calender at the WestRock pilot plant. The gloss-type calender included a counter roller covered with a soft polyurethane cover and applied a nip load of around 150 pli while roller surface temperatures were maintained around 200° F.

The coated paperboard structure had a total basis weight of 164 lbs/3000 $ft^2$, a caliper of about 0.0155 inches (15.5 points), and a Parker Print Surf (PPS 10S) roughness of about 1.9 microns.

Example 2

An uncoated solid bleached sulfate (SBS) paperboard substrate having a basis weight of about 145 lbs/3000 $ft^2$ was prepared using a full-scale production process. Starch was applied to the surface of the SBS board during production.

The paperboard substrate was calendered by Valmet Technologies Oy of Järvenpää, Finland using a hot-hard calender having a two roll (e.g., one nip) design. The hot-hard calender included one thermo-roller and one counter roller. The nip load was about 140 pli and the surface temperature of the thermo-roller was about 480° F.

A basecoat was prepared as a mixture of 50 parts high aspect ratio clay, 50 parts of extra coarse calcium carbonate, 17 parts of a Styrene-Acrylic Binder, 4 parts of a surfactant stabilized polyvinyl acetate, and minor amounts of dispersant.

A topcoat was also prepared as a mixture of 60 parts of fine carbonate, 40 parts of fine clay, 9 parts of Styrene-Acrylic Binder, 3 parts of a surfactant stabilized polyvinyl acetate, less than 2% of Polyvinyl Alcohol, and minor amounts of dispersant and lubricant.

The calendered paperboard substrate was then coated on one side (C1S) with the basecoat and then the topcoat. The total quantity of applied coating (basecoat and topcoat) was about 12 lbs/3000 $ft^2$.

The coated paperboard structure was then final calendered using a gloss-type calender at the WestRock pilot plant. The gloss-type calender included a counter roller covered with a soft polyurethane cover and applied a nip load of around 150 pli while roller surface temperatures were maintained around 200° F.

The coated paperboard structure had a total basis weight of 161 lbs/3000 $ft^2$, a caliper of about 0.0151 inches (15.1 points), and a Parker Print Surf (PPS 10S) roughness of about 1.9 microns.

Example 3

An uncoated solid bleached sulfate (SBS) paperboard substrate having a basis weight of about 145 lbs/3000 $ft^2$ was prepared using a full-scale production process. Starch was applied to the surface of the SBS board during production.

The paperboard substrate was calendered by Valmet Technologies Oy of Järvenpää, Finland using a hot-hard calender having a two roll (e.g., one nip) design. The hot-hard calender included one thermo-roller and one counter roller. The nip load was about 140 pli and the surface temperature of the thermo-roller was about 480° F.

A basecoat was prepared as a mixture of 50 parts high aspect ratio clay, 50 parts of extra coarse calcium carbonate, 17 parts of a Styrene-Acrylic Binder, 4 parts of a surfactant stabilized polyvinyl acetate, and minor amounts of dispersant.

A topcoat was also prepared as a mixture of 60 parts of fine carbonate, 40 parts of fine clay, 9 parts of Styrene-Acrylic Binder, 3 parts of a surfactant stabilized polyvinyl acetate, less than 2% of Polyvinyl Alcohol, and minor amounts of dispersant and lubricant.

The calendered paperboard substrate was then coated on one side (C1S) with the basecoat and then the topcoat. The total quantity of applied coating (basecoat and topcoat) was about 16 lbs/3000 $ft^2$.

The coated paperboard structure was then final calendered using a gloss-type calender at the WestRock pilot plant. The gloss-type calender included a counter roller covered with a soft polyurethane cover and applied a nip load of around 150 pli while roller surface temperatures were maintained around 200° F.

The coated paperboard structure had a total basis weight of 164 lbs/3000 $ft^2$, a caliper of about 0.0153 inches (15.3 points), and a Parker Print Surf (PPS 10S) roughness of about 1.7 microns.

Example 4

An uncoated solid bleached sulfate (SBS) paperboard substrate having a basis weight of about 104 lbs/3000 $ft^2$ was prepared using a full-scale production process. Starch was applied to the surface of the SBS board during production.

The paperboard substrate was calendered by Valmet Technologies Oy of Järvenpää, Finland using a hot-hard calender having a three roll (e.g., two nip) design. The hot-hard calender included one thermo-roller and one counter roller. The nip load was about 90 pli and the surface temperature of the thermo-roller was about 500° F.

A basecoat was prepared as a mixture of 50 parts high aspect ratio clay, 50 parts of extra coarse calcium carbonate, 17 parts of a Styrene-Acrylic Binder, 4 parts of a surfactant stabilized polyvinyl acetate, and minor amounts of dispersant.

A topcoat was also prepared as a mixture of 60 parts of fine carbonate, 40 parts of fine clay, 9 parts of Styrene-Acrylic Binder, 3 parts of a surfactant stabilized polyvinyl acetate, less than 2% of Polyvinyl Alcohol, and minor amounts of dispersant and lubricant.

The calendered paperboard substrate was then coated on one side (C1S) with the basecoat and then the topcoat. The total quantity of applied coating (basecoat and topcoat) was about 12 lbs/3000 $ft^2$.

The coated paperboard structure was then final calendered using a gloss-type calender at the WestRock pilot plant. The gloss-type calender included a counter roller covered with a soft polyurethane cover and applied a nip load of around 150 pli while roller surface temperatures were maintained around 200° F.

The coated paperboard structure had a total basis weight of 119 lbs/3000 $ft^2$, a caliper of about 0.0105 inches (10.5 points), and a Parker Print Surf (PPS 10S) roughness of about 1.3 microns.

Example 5

An uncoated solid bleached sulfate (SBS) paperboard substrate having a basis weight of about 104 lbs/3000 $ft^2$ was prepared using a full-scale production process. Starch was applied to the surface of the SBS board during production.

The paperboard substrate was calendered by Valmet Technologies Oy of Järvenpää, Finland using a hot-hard calender having a three roll (e.g., two nip) design. The hot-hard calender included one thermo-roller and one counter roller. The nip load was about 90 pli and the surface temperature of the thermo-roller was about 500° F.

A basecoat was prepared as a mixture of 50 parts high aspect ratio clay, 50 parts of extra coarse calcium carbonate, 17 parts of a Styrene-Acrylic Binder, 4 parts of a surfactant stabilized polyvinyl acetate, and minor amounts of dispersant.

A topcoat was also prepared as a mixture of 60 parts of fine carbonate, 40 parts of fine clay, 9 parts of Styrene-Acrylic Binder, 3 parts of a surfactant stabilized polyvinyl acetate, less than 2% of Polyvinyl Alcohol, and minor amounts of dispersant and lubricant.

The calendered paperboard substrate was then coated on one side (C1S) with the basecoat and then the topcoat. The total quantity of applied coating (basecoat and topcoat) was about 12 lbs/3000 $ft^2$.

The coated paperboard structure was then final calendered using a gloss-type calender at the WestRock pilot plant. The gloss-type calender included a counter roller covered with a soft polyurethane cover and applied a nip load of around 150 pli while roller surface temperatures were maintained around 200° F.

The coated paperboard structure had a total basis weight of 117 lbs/3000 $ft^2$, a caliper of about 0.0103 inches (10.3 points), and a Parker Print Surf (PPS 10S) roughness of about 1.4 microns.

Example 6

An uncoated solid bleached sulfate (SBS) paperboard substrate having a basis weight of about 104 lbs/3000 $ft^2$ was prepared using a full-scale production process. Starch was applied to the surface of the SBS board during production.

The paperboard substrate was calendered by Valmet Technologies Oy of Järvenpää, Finland using a hot-hard calender having a two roll (e.g., one nip) design. The hot-hard calender included one thermo-roller and one counter roller. The nip load was about 90 pli and the surface temperature of the thermo-roller was about 500° F.

A basecoat was prepared as a mixture of 50 parts high aspect ratio clay, 50 parts of extra coarse calcium carbonate, 17 parts of a Styrene-Acrylic Binder, 4 parts of a surfactant stabilized polyvinyl acetate, and minor amounts of dispersant.

A topcoat was also prepared as a mixture of 60 parts of fine carbonate, 40 parts of fine clay, 9 parts of Styrene-Acrylic Binder, 3 parts of a surfactant stabilized polyvinyl acetate, less than 2% of Polyvinyl Alcohol, and minor amounts of dispersant and lubricant.

The calendered paperboard substrate was then coated on one side (C1S) with the basecoat and then the topcoat. The total quantity of applied coating (basecoat and topcoat) was about 15 lbs/3000 $ft^2$.

The coated paperboard structure was then final calendered using a gloss-type calender at the WestRock pilot plant. The gloss-type calender included a counter roller covered with a soft polyurethane cover and applied a nip load of around 150 pli while roller surface temperatures were maintained around 200° F.

The coated paperboard structure had a total basis weight of 120 lbs/3000 $ft^2$, a caliper of about 0.0106 inches (10.6 points), and a Parker Print Surf (PPS 10S) roughness of about 1.3 microns.

Comparative Examples 1-6

For each of the above examples, a Comparative Example was also prepared to demonstrate the improvement presented by the disclosed method (e.g., Comparative Example 1 is comparable to Example 1, Comparative Example 2 is comparable to Example 2, and so on). The paperboard substrate for each Comparative Example was initially prepared in the same manner as the corresponding Example (e.g., uncoated, same basis weight and with starch applied). However, instead of being calendered by a hot-hard calender, the paperboard substrates of the Comparative Examples were calendered using a traditional calender under traditional calendering conditions. Compared to any of the Examples, the nip load applied to the Comparative Examples was much higher at 350 pli and the roller surface temperatures was much lower at 200° F. After being calendered, the Comparative Examples were coated in the same manner and with the same basecoat and topcoat formulations at their corresponding Examples. The Comparative Examples were also final calendered in the same manner as their corresponding Examples.

SUMMARY

The results are summarized in Tables 1 and 2 presented below. Table 1 presents the conditions under which the paperboard substrates were calendered prior to being coated and Table 2 presents the resulting data after having been coated.

TABLE 1

| | Nip Load (pli) | Roller Surface Temp. (° F.) | Qty of Nips |
|---|---|---|---|
| Example 1 | 140 | 480 | 1 |
| Example 2 | 140 | 480 | 1 |
| Example 3 | 140 | 480 | 1 |
| Example 4 | 90 | 500 | 2 |
| Example 5 | 90 | 500 | 2 |
| Example 6 | 90 | 500 | 1 |
| Comparative Example 1 | 350 | 200 | 4 |
| Comparative Example 2 | 350 | 200 | 4 |
| Comparative Example 3 | 350 | 200 | 4 |
| Comparative Example 4 | 350 | 200 | 4 |
| Comparative Example 5 | 350 | 200 | 4 |
| Comparative Example 6 | 350 | 200 | 4 |

TABLE 2

| | Actual Caliper (points) | Basis Weight (lbs/3,000 $ft^2$) | Density (lbs/3,000 $ft^2$/points) | PPS (microns) | Total Coat Weight (lbs/3,000 $ft^2$) |
|---|---|---|---|---|---|
| Example 1 | 15.5 | 164 | 10.6 | 1.9 | 14 |
| Example 2 | 15.1 | 161 | 10.6 | 1.9 | 12 |
| Example 3 | 15.3 | 164 | 10.8 | 1.7 | 16 |
| Example 4 | 10.5 | 119 | 11.3 | 1.3 | 12 |
| Example 5 | 10.3 | 117 | 11.3 | 1.4 | 12 |
| Example 6 | 10.6 | 120 | 11.3 | 1.3 | 15 |

TABLE 2-continued

| | Actual Caliper (points) | Basis Weight (lbs/3,000 ft$^2$) | Density (lbs/3,000 ft$^2$/points) | PPS (microns) | Total Coat Weight (lbs/3,000 ft$^2$) |
|---|---|---|---|---|---|
| Comparative Example 1 | 14.6 | 162 | 11.1 | 1.9 | 13 |
| Comparative Example 2 | 14.8 | 164 | 11.1 | 1.6 | 15 |
| Comparative Example 3 | 14.6 | 164 | 11.1 | 1.8 | 15 |
| Comparative Example 4 | 10.3 | 120 | 11.7 | 1.4 | 11 |
| Comparative Example 5 | 10.3 | 123 | 11.9 | 1.2 | 14 |
| Comparative Example 6 | 10.3 | 121 | 11.8 | 1.3 | 12 |

As shown in Tables 1 and 2, a comparably smooth paperboard structure may be manufactured using the disclosed method (which utilizes the hot-hard calender) despite applying a significantly lower nip load. The nip loads applied in Examples 1-6 ranged from 60% to 74.3% lower than the nip loads applied in their corresponding Comparative Examples. Without being bound by any particular theory, it is believed that calendering paperboard substrates at significantly higher temperatures may compensate for lower nip loads in achieving a desired smoothness.

Figure 4:
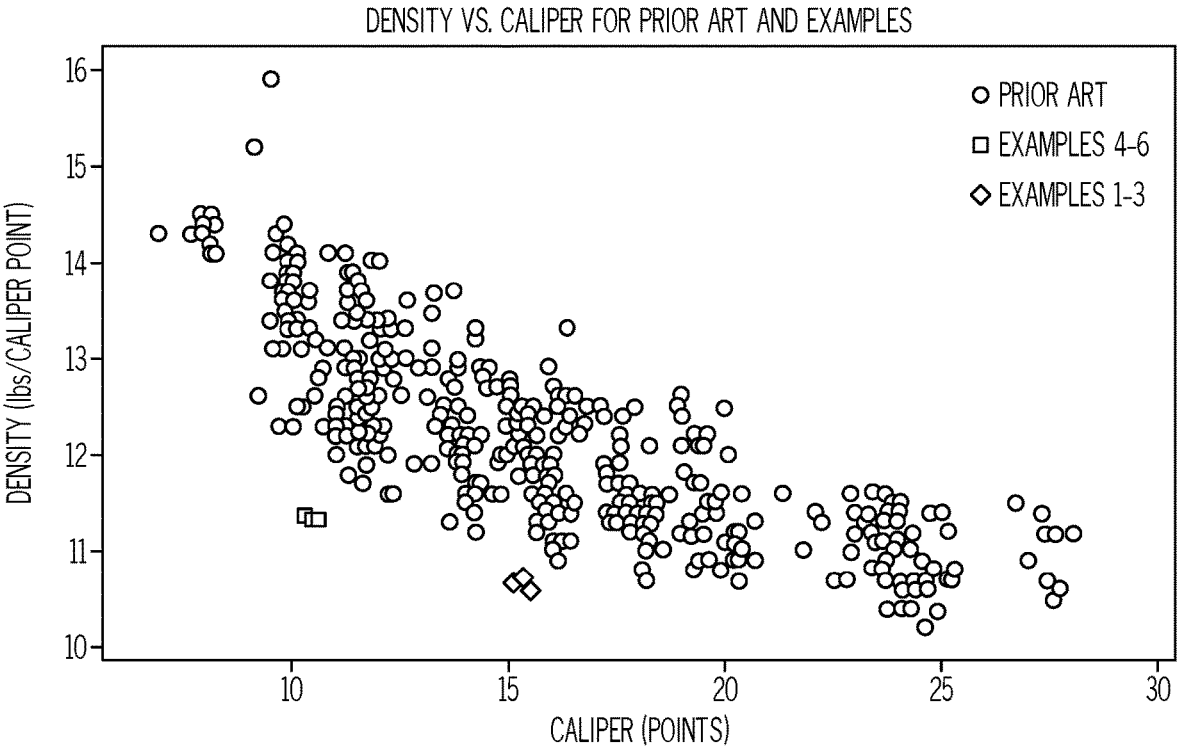
FIG. 4 is a graphical representation of density versus caliper thickness of various examples of the disclosed smooth, low density paperboard structures, as well as prior art examples.

The density (e.g., basis weight divided by caliper) versus caliper data from Examples 1-6, together with density versus caliper data for prior art paperboard, is plotted in FIG. 4. Those skilled in the art will appreciate that significantly lower densities are achieved when paperboard is prepared in accordance with the present disclosure. Those skilled in the art will also appreciate that density is a function of caliper, so one should compare individual calipers separately when evaluating Parker Print Surf smoothness (PPS).

Figure 5:
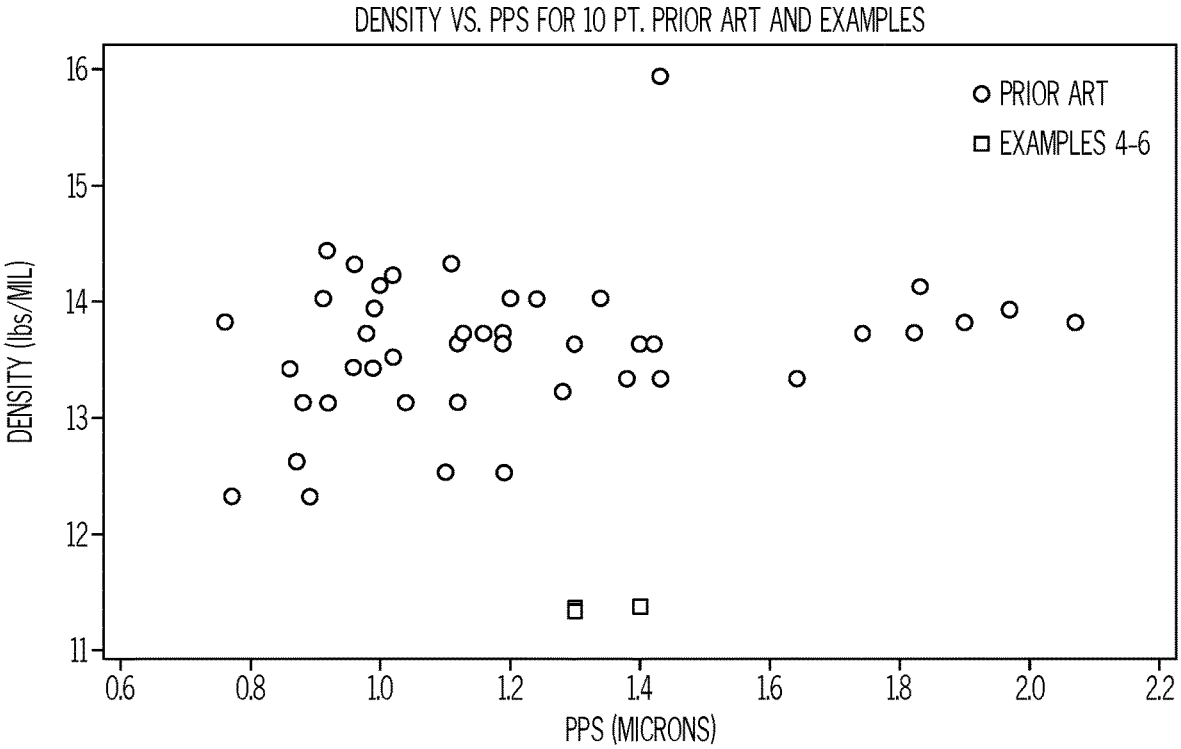
FIG. 5 is a graphical representation of density versus Parker Print Surf smoothness of various examples of the disclosed smooth, low density paperboard structures having a caliper thickness of about 10 points, as well as prior art examples.
Figure 6:
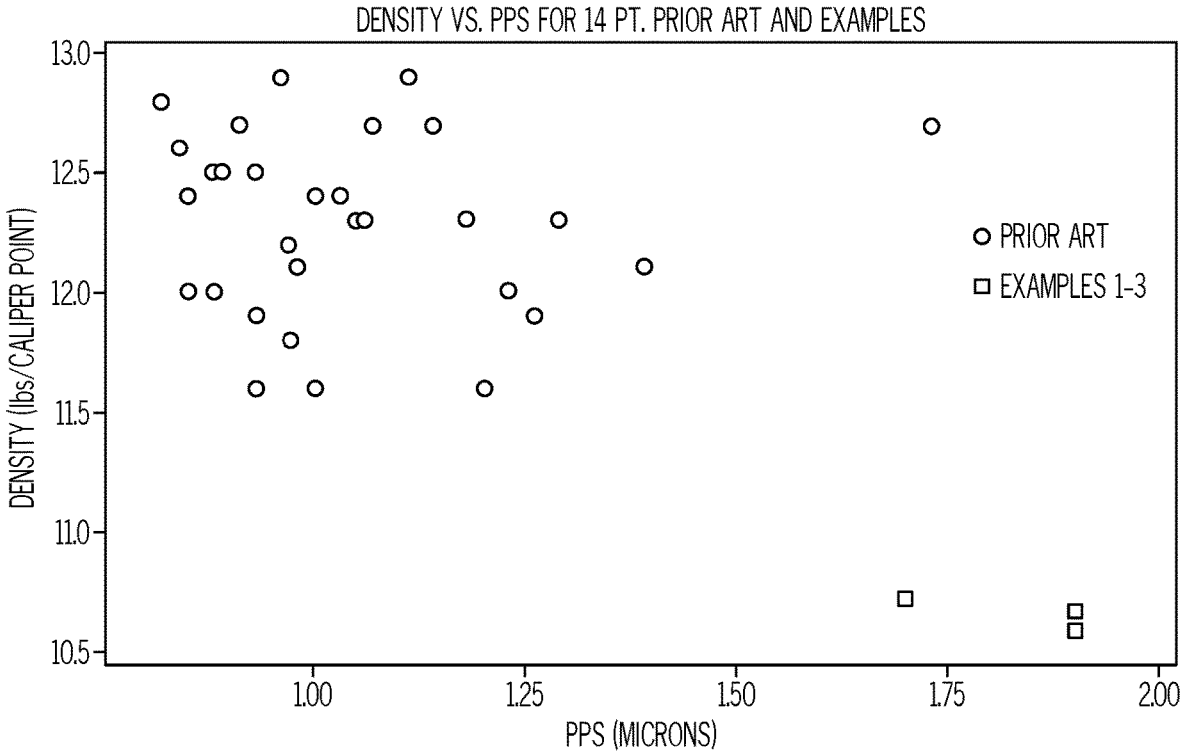
FIG. 6 is a graphical representation of density versus Parker Print Surf smoothness of various examples of the disclosed smooth, low density paperboard structures having a caliper thickness of about 14 points, as well as prior art examples.

FIG. 5 illustrates density versus Parker Print Surf smoothness for a 10 point board (Examples 4-6) in accordance with the present disclosure, plotted against density versus Parker Print Surf smoothness of prior art 10 point board. FIG. 6 illustrates density versus Parker Print Surf smoothness of 14 point board (Examples 1-3), plotted against density versus Parker Print Surf smoothness of prior art 14 point board. Those skilled in the art will appreciate that the paperboard of the present disclosure presents significantly lower densities relative to the prior art, while maintaining smoothness (e.g., lower Parker Print Surf smoothness values).

Figure 7:
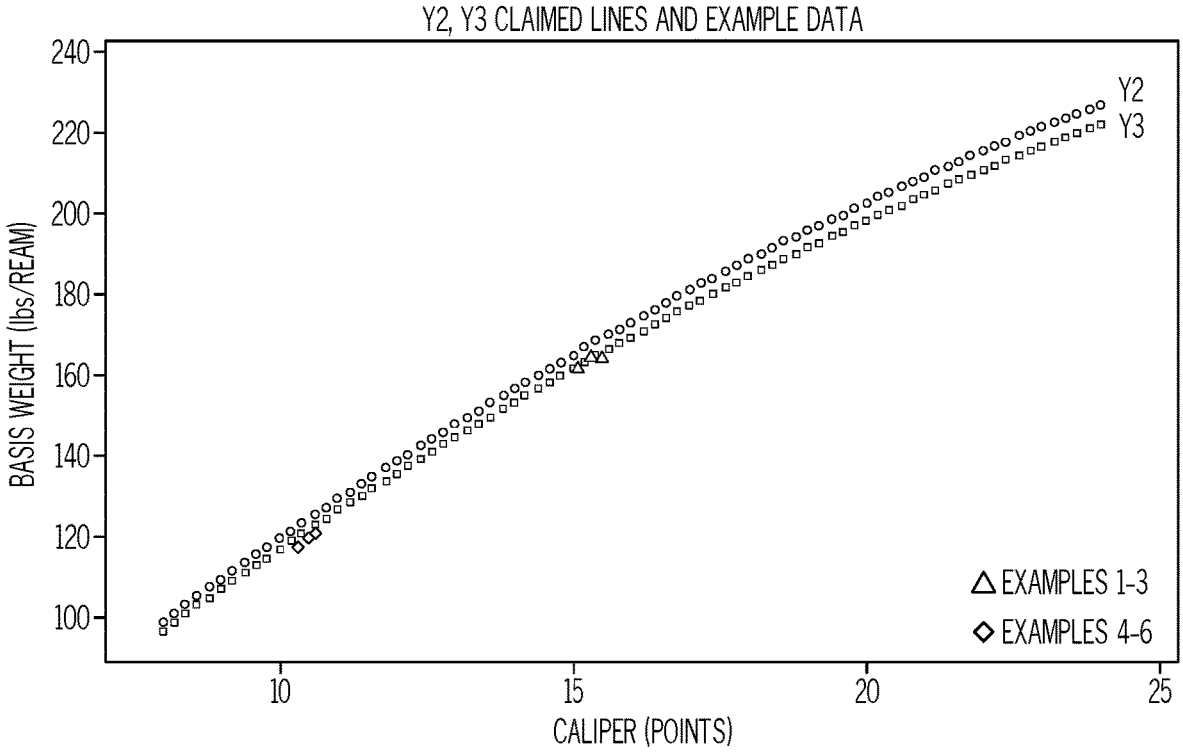
FIG. 7 is a graphical representation of basis weight versus caliper thickness of various examples of the disclosed smooth, low density paperboards.
Figure 8:
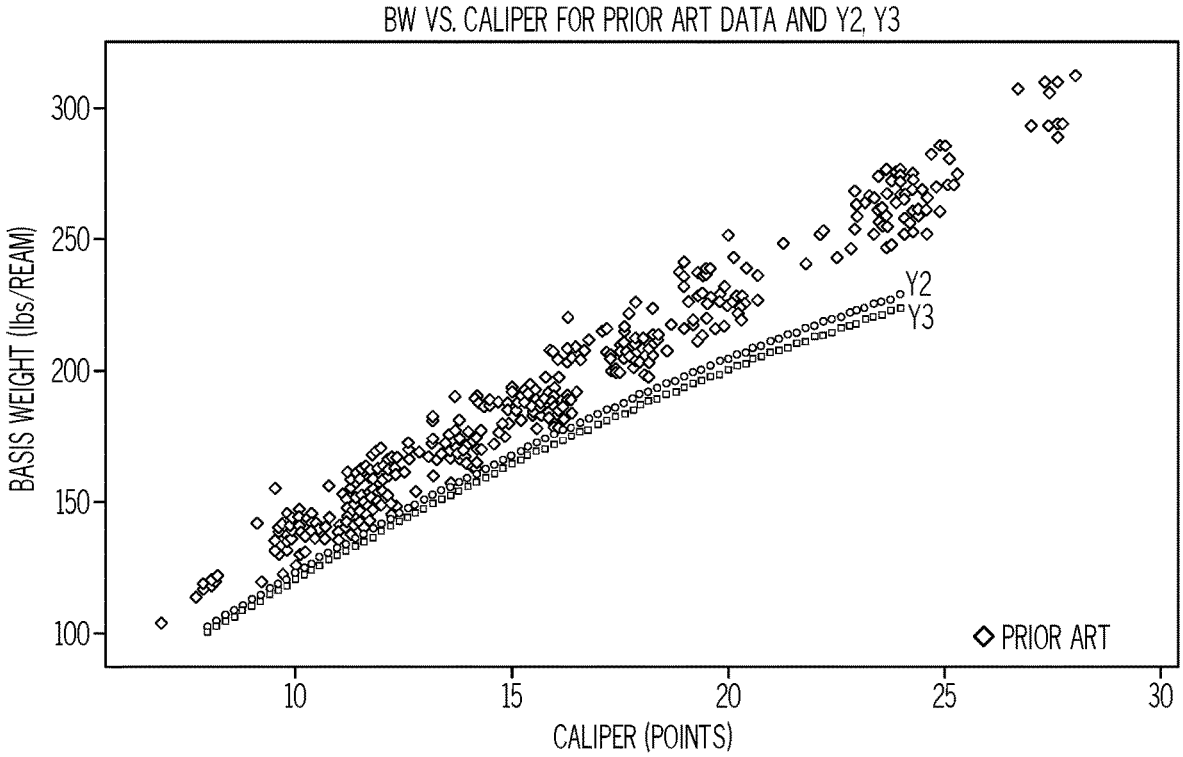
FIG. 8 is a graphical representation of basis weight versus caliper thickness for the disclosed smooth, low density paperboards, as well as prior art examples.

The basis weight versus caliper data from Examples 1-6 is plotted in FIG. 7 and the basis weight versus caliper data for prior art paperboard is plotted in FIG. 8. All the data points from Examples 1-6 fall below curve $Y_2$, which is a plot of $Y_2=3.71+13.14X-0.1602X^2$, while all of the prior art data is found above curve $Y_2$. Furthermore, five of the data points from the disclosed Examples fall below curve $Y_3$, which is a plot of $Y_3=3.63+12.85X-0.1566X^2$.

Figure 9:
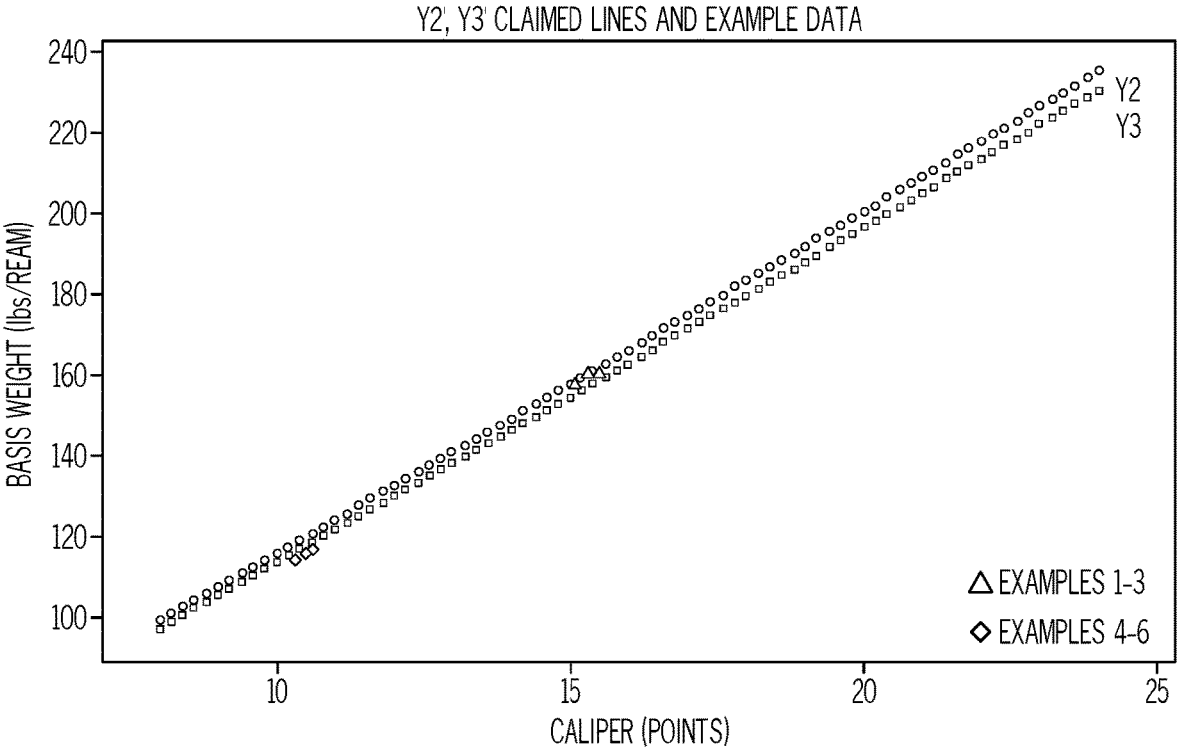
FIG. 9 is a graphical representation of basis weight versus caliper thickness of various examples of the disclosed smooth, low density paperboards.
Figure 10:
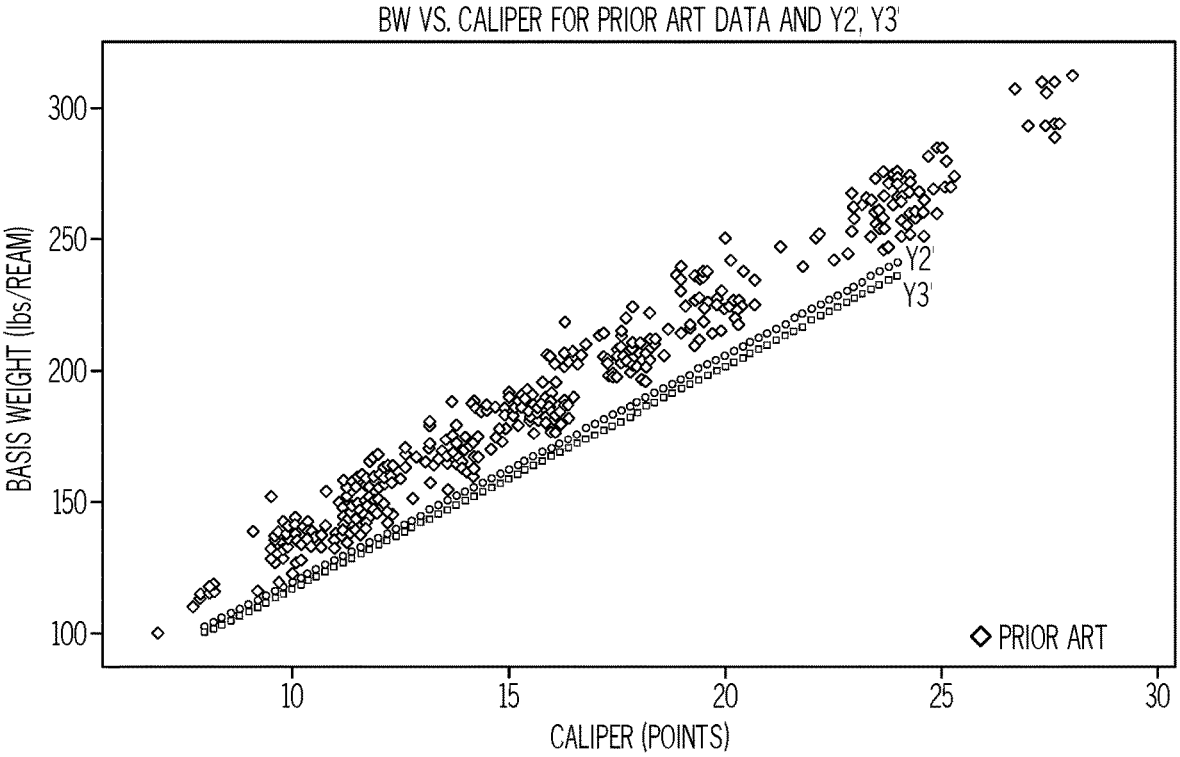
FIG. 10 is a graphical representation of basis weight versus caliper thickness for the disclosed smooth, low density paperboards, as well as prior art examples.

Similarly, basis weight versus caliper data of paperboard structures prepared in accordance with the present disclosure is plotted in FIG. 9 and the basis weight versus caliper data for prior art paperboard is plotted in FIG. 10. All of the data points from Examples 1-6 fall below curve $Y_2'$, which is a plot of $Y_2'=35.55+8.173X-0.01602X^2$, while all of the prior art data is found above curve $Y_2'$. Furthermore, three data points fall below curve $Y_3'$, which is a plot of $Y_3'=34.83+8.010X-0.01570X^2$.

While basis weight data is currently presented in FIGS. 7-10 for caliper thickness of 10 and 14, those skilled in the art will appreciate that since the disclosed method and coatings were capable of achieving surprising low densities while simultaneously maintaining smoothness, it is to be expected that similar low densities and smoothness's may be achieved at other caliper thicknesses. In one or more examples, the paperboard structure may have a Parker Print Surf smoothness of at most 2.5 microns. In one or more examples, the paperboard structure may have a Parker Print Surf smoothness of 2.0 microns. In one or more examples, the paperboard structure may have a Parker Print Surf smoothness of 1.5 microns.

Accordingly, the method of the present disclosure provides desired smoothness (e.g., PPS 10S smoothness below 3 microns), while maintaining low board density (e.g., basis weight below the disclosed thresholds as a function of caliper thickness).

Although various aspects of the disclosed method for manufacturing a paperboard structure, and the paperboard structures manufactured by such methods, have been shown and described, modifications may occur to those skilled in the art upon reading the specification. The present patent application includes such modifications and is limited only by the scope of the claims.

What is claimed is:

1. A method for manufacturing a paperboard structure comprising:

passing a paperboard substrate through a hot-hard calender to yield a calendered paperboard substrate, said hot-hard calender comprising a nip defined by a thermo-roller and a counter roller, wherein a contact surface of said thereto-roller is heated to an elevated temperature of at least 250° F.;

applying a basecoat to said calendered paperboard substrate to yield a basecoated paperboard substrate, said basecoat comprising a basecoat binder and a basecoat pigment; and applying a topcoat to said basecoated paperboard substrate, wherein said paperboard structure has a basis weight, a caliper thickness and a Parker Print Surf (PPS 10S) smoothness, said Parker Print Surf (PPS 10S) smoothness being at most 3 microns, said basis weight being at most $Y_2$ pounds per 3000 ft$^2$, wherein $Y_2$ is a function of said caliper thickness (X) in points and is calculated as follows:

$$Y_2=3.71+13.14X-0.1602X^2.$$

2. The method of claim 1 wherein said passing said paperboard substrate through said hot-hard calender comprises applying a nip load to said paperboard substrate ranging from about 20 pli to about 500 pli.

3. The method of claim 1 wherein said elevated temperature is at least 500° F.

4. The method of claim 1 further comprising applying starch to said paperboard substrate prior to said passing said paperboard substrate through said hot-hard calender.

5. The method of claim 1 wherein said hot-hard calender further comprises a second nip defined by said thermo-roller and a second counter roller, and wherein said passing said paperboard substrate comprises passing said paperboard substrate through said nip and said second nip.

6. The method of claim 1 wherein at least one of said thermo-roller and said counter roller comprises a metallic material.

7. The method of claim 1 wherein said basecoat is applied to only one side of said calendered paperboard substrate.

8. The method of claim 1 further comprising applying an intermediate coating layer to said basecoated paperboard substrate prior to said applying said topcoat.

9. The method of claim 1 wherein said basecoat binder comprises latex.

10. The method of claim 1 wherein said basecoat pigment comprises at least one of clay and calcium carbonate.

11. The method of claim 1 wherein said basecoat pigment comprises clay and calcium carbonate.

12. The method of claim 11 wherein said clay has an average aspect ratio of at least about 40:1.

13. The method of claim 11 wherein said calcium carbonate is ground calcium carbonate.

14. The method of claim 13 wherein at most about 60 percent by weight of said ground calcium carbonate has a particle size smaller than 2 microns.

15. The method of claim 13 wherein said ground calcium carbonate comprises at least about 10 percent by weight of said basecoat pigment and at most about 60 percent by weight of said basecoat pigment.

16. The method of claim 1 wherein said topcoat comprises a topcoat binder and a topcoat pigment blend.

17. The method of claim 16 wherein said topcoat binder comprises latex.

18. The method of claim 16 wherein said topcoat pigment blend comprises calcium carbonate and clay.

19. The method of claim 1 wherein said applying said basecoat and said applying said topcoat yields a coating structure on said paperboard substrate, said coating structure having a total coat weight, on a dry basis, ranging from about 8 lbs/3000 $ft^2$ to about 18 lbs/3000 $ft^2$.

20. The method of claim 1 wherein said Parker Print Surf (PPS 10S) smoothness is at most 2.5 microns.

21. The method of claim 1 wherein said paperboard structure has a basis weight, a caliper thickness and a Parker Print Surf (PPS 10S) smoothness, said Parker Print Surf (PPS 10S) smoothness being at most 3 microns, said basis weight being at most $Y_2'$ pounds per 3000 $ft^2$, wherein $Y_2'$ is a function of said caliper thickness (X) in points and is calculated as follows:

$$Y_2'=35.55+8.173X-0.01602X^2.$$

22. The method of claim 1 wherein said paperboard structure has a basis weight, a caliper thickness and a Parker Print Surf (PPS 10S) smoothness, said Parker Print Surf (PPS 10S) smoothness being at most 3 microns, said basis weight being at most $Y_3$ pounds per 3000 $ft^2$, wherein $Y_3$ is a function of said caliper thickness (X) in points and is calculated as follows;

$$Y_3=3.63+12.85X-0.1566X^2.$$

23. The method of claim 1 wherein said paperboard structure has a basis weight, a caliper thickness and a Parker Print Surf (PPS 10S) smoothness, said Parker Print Surf (PPS 10S) smoothness being at most 3 microns, said basis weight being at most $Y_3'$ pounds per 3000 $ft^2$, wherein $Y_3'$ is a function of said caliper thickness (X) in points and is calculated as follows:

$$Y_3'=34.83+8.010X-0.01570X^2.$$

* * * * *